United States Patent [19]

Korsunsky et al.

[11] Patent Number: 4,986,765

[45] Date of Patent: Jan. 22, 1991

[54] INSERTABLE LATCH MEANS FOR USE IN AN ELECTRICAL CONNECTOR

[75] Inventors: Iosif Korsunsky, Harrisburg; Richard C. Schroepfer, Thompsontown; Monte L. Kopp, Tower City, all of Pa.

[73] Assignee: AMP Incorporated, Harrisburg, Pa.

[21] Appl. No.: 313,261

[22] Filed: Feb. 21, 1989

[51] Int. Cl.[5] ..... H01R 9/09

[52] U.S. Cl. ..... 439/326; 439/636; 439/856

[58] Field of Search ..... 439/326, 335, 629, 630, 439/634, 635, 636, 744, 856

[56] References Cited

U.S. PATENT DOCUMENTS

| | | | |
|---|---|---|---|
| 3,718,895 | 2/1973 | Reynolds et al. | 339/258 |
| 3,784,955 | 1/1974 | Reynolds et al. | 339/17 |
| 3,803,533 | 4/1974 | Taplin | 339/91 |
| 3,920,303 | 11/1975 | Pittman et al. | 439/326 |
| 4,080,037 | 3/1978 | Kunkle et al. | 339/258 |
| 4,129,351 | 12/1978 | Sugimoto et al. | 439/630 X |
| 4,362,353 | 12/1982 | Cobaugh | 339/258 |
| 4,384,757 | 5/1983 | Andrews et al. | 339/258 |
| 4,709,302 | 11/1987 | Jordan et al. | 361/388 |
| 4,713,013 | 12/1987 | Regnier et al. | 439/326 X |
| 4,722,700 | 2/1988 | Kuhn et al. | 439/629 |
| 4,737,120 | 4/1988 | Grabbe et al. | 439/326 |
| 4,781,612 | 11/1988 | Thrush | 439/630 X |

FOREIGN PATENT DOCUMENTS

| | | |
|---|---|---|
| 0093510 | 11/1983 | European Pat. Off. . |
| 2258760 | 8/1975 | France . |
| 0277873 | 8/1988 | France . |

OTHER PUBLICATIONS

Search Report 85227 U.S.

*Primary Examiner*—Z. R. Bilinsky
*Attorney, Agent, or Firm*—Bruce J. Wolstoncroft

[57] ABSTRACT

An electrical connector (2) has a dielectric housing with contact terminals (22) which extend therethrough. The contact terminals (22) are provided to electrically connect a mother board (4) to a daughter card (6). A board-receiving opening (20) is provided in the housing for reception of the daughter card (6) therein. Proximate to the board-receiving opening (20) are latch receiving openings (24) which are dimensioned to receive insertable latch members (40) therein. The latch members (40) are manufactured from material having the desired resilient and strength characteristics, thereby insuring that the latch members (40) will be effective over many cycles. Each latch member (40) has a resilient section (42) for cooperating with the daughter card (6) and a mounting section (44) for cooperating with the mother board (4). The resilient section (42) is able to accommodate a range of board sizes without taking a permanent set. If required the latch members (40) can have enhanced electrical characteristics so that the power and ground connections between the mother board (4) and the daughter card (6) can be made through the latch members (40).

19 Claims, 5 Drawing Sheets

INSERTABLE LATCH MEANS FOR USE IN AN ELECTRICAL CONNECTOR

FIELD OF THE INVENTION

The invention is directed to a latch means for use in an electrical connector. In particular, the latch means are insertable into a housing of the connector to cooperate with respective circuit boards, the latch means being configured to accommodate the wide tolerance range associated with the circuit boards.

BACKGROUND OF THE INVENTION

Many electrical connectors are known which provide electrical connection between contact surfaces of a daughter board and contact areas of a mother board. In general, the connector has contacts positioned therein which extend from a first mating surface of the connector to a second mating surface. The contacts have posts which extend from the connector and make electrical engagement with the contact areas of the mother board. The daughter board is then inserted into the connector and rotated to its operating position. As this rotation occurs, contact projections of the contacts engage the contact surfaces of the daughter board. In order for this electrical engagement to be maintained, it is essential that latch arms be provided to cooperate and maintain the daughter board in the operational position.

An example of this type of electrical connector is described in U.S. Pat. No. 4,737,120. As is shown in FIG. 1 of that patent, the latch members are provided at the ends of the connector, and are integrally molded with the housing. The configuration of the latch members provides the latch members with the resilient characteristics required in order to allow the latch members to cooperate with the daughter board to maintain the daughter board in electrical engagement with the terminals of the connector.

However, several problems are associated with the configuration of the latch member described above. As the latch members are molded from plastic material, and as the resilient characteristics of plastic is not significant, the latch members are likely to take a permanent set, particularly when the connector is used over many cycles. This likelihood is increased due to the fact that the latch members must have a relatively thin width when molded. This requirement reduces the durability of the latch members, so that the latch members are only strong enough to support approximately 25 cycles (insertions and removals of the printed circuit board). Consequently, if the electrical connector is to be used over many cycles, the risk of failure of the electrical connector is greatly increased.

It is also important to note that a relatively small displacement of the molded latch is enough to cause the latch to take a permanent set. Consequently, as the daughter board can vary in size, and still fall within the tolerance limits for the connector, it is possible that a relatively large board will be inserted into the slots, and then be followed by a relatively small board. The insertion of the large board into the slot can cause the plastic latch to take a permanent set, so that as the small board is inserted, the latch will not be effective in maintaining the board in the slot, resulting in an ineffective connector.

It would therefore be advantageous if the latch members could be made from a material having the desired resilient characteristics. This requires the latch members to be separately manufactured and inserted into the housing after the housing has been molded.

Another problem associated with the connector disclosed in U.S. Pat. No. 4,737,120, and other similar connectors, relates to the mounting posts. Generally, mounting posts cooperate with openings in the mother board to position and maintain the connector and terminals in place until soldering or the like occurs. However, it is important to note, that the dimensions of the posts must be minimized, as the space available on printed circuit boards is at a premium. Consequently, the width of the posts must be held to a minimum in order for the connector to occupy a minimal amount of board real estate. This miniaturization of the post causes the post to be relatively weak, particularly because the post is manufactured from molded plastic. Therefore, as the post is relatively weak, it is possible that damage will occur to the post during the shipping of the connector, thereby resulting in an ineffective connector.

It would therefore be advantageous if the post could be strengthened without the need to increase the area which the post occupies. The utilization of this type of post would require the post to be attached to the connector in some manner, as the post would no longer be able to be molded at the same time as the housing of the connector.

SUMMARY OF THE INVENTION

The invention is directed to an electrical connector which has an improved latch member provided at each end thereof. Each latch member has an integral mounting post which extends beyond the connector to cooperate with the mother board. The latch members are constructed from a material which has the resilient and strength characteristics required to insure for effective operation over many cycles. It is also possible to provide the latch members with adequate electrical properties, so that the latch members may be used to supply power from the mother board to the daughter board.

An insertable latch member is described for use in an electrical connector. The electrical connector has a housing with a first major surface and an oppositely facing second major surface A daughter or baby board receiving recess extends from the first major surface toward the second major surface Contact terminals are provided adjacent to the baby board receiving recess and extend from the baby board receiving recess to beyond the second major surface. Latch receiving recesses are provided adjacent to the baby board receiving recess, and are dimensioned to receive the latch member therein.

Each latch member has a resilient section and mounting section which is integrally attached to the resilient section. The resilient section has a resilient arm which extends from a base portion of the resilient section. A free end of the resilient arm is formed to provide a projection which extends in a direction which is essentially perpendicular to the longitudinal axis of the resilient arm. The mounting section extends from the base portion of the resilient section, and is dimensioned to be received in an aperture of a printed circuit board. The resilient section and the mounting section form an electrically conductive pathway across which electrical signals are conducted.

DETAILED DESCRIPTION OF THE INVENTION

Figure 1:
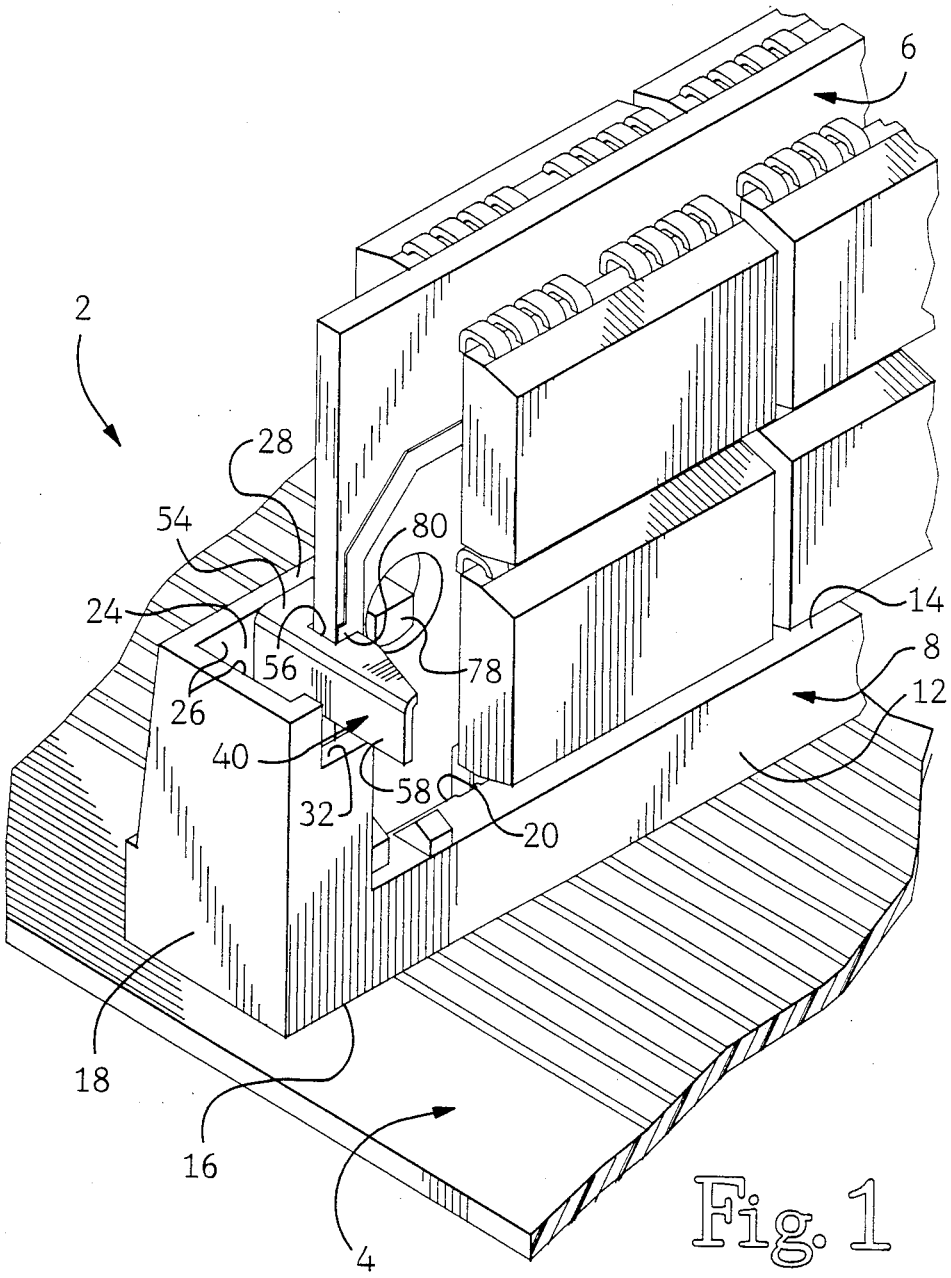
FIG. 1 is a perspective view of a connector with an insertable latch member provided therein, the connector electrically connects a mother board with a daughter card.
Figure 2:
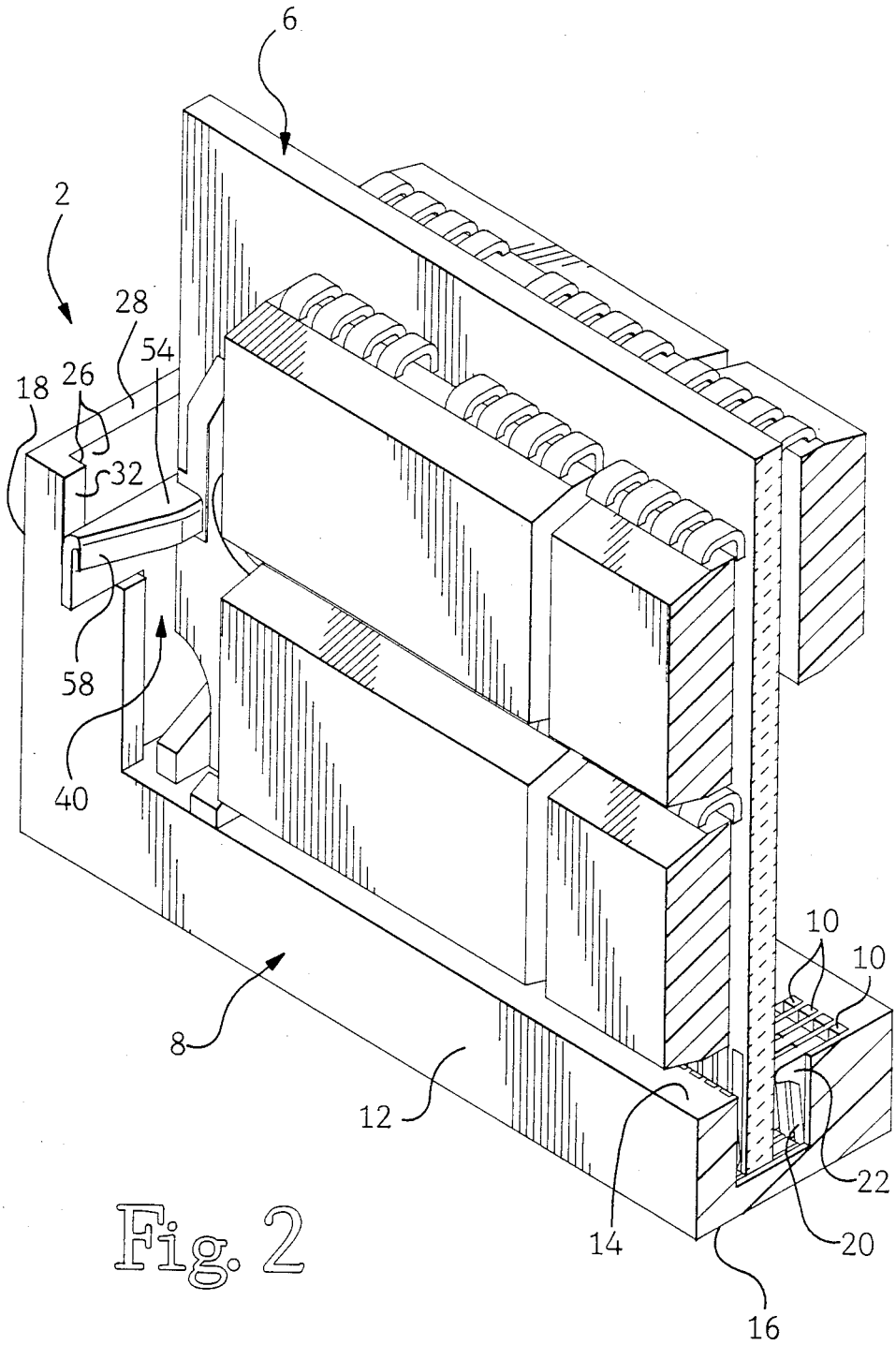
FIG. 2 is a perspective view of the connector, showing the cooperation of the latch member with the daughter card.

Referring to FIGS. 1 and 2, there is illustrated a low insertion force electrical connector 2. The connector electrically and mechanically connects printed circuit board 4 to printed circuit board 6.

The connector 2 has an elongated housing 8 having a plurality of contact receiving cavities 10 located in an elongated base 12. The housing is made from any material having the desired dielectric characteristics.

The plurality of contact receiving cavities 10, as shown in FIG. 2, extend from top surface 14 of base 12 to proximate bottom surface 16 of the base. The cavities are provided in spaced apart parallel relationship to each other and to ends 18 of base 8. The cavities are in communication with a board-receiving opening 20. The exact shape of the cavities 10 varies according to the shape of contacts 22 to be secured therein.

Contacts 22 are disposed in cavities 10. Each contact is made from sheet metal stock having the desired conductive and resilient characteristics. A more detailed explanation of a particular type of contact which can be used in the connector is more fully disclosed in U.S. Pat. No. 4,737,120, which is hereby incorporated by reference.

Figure 3:
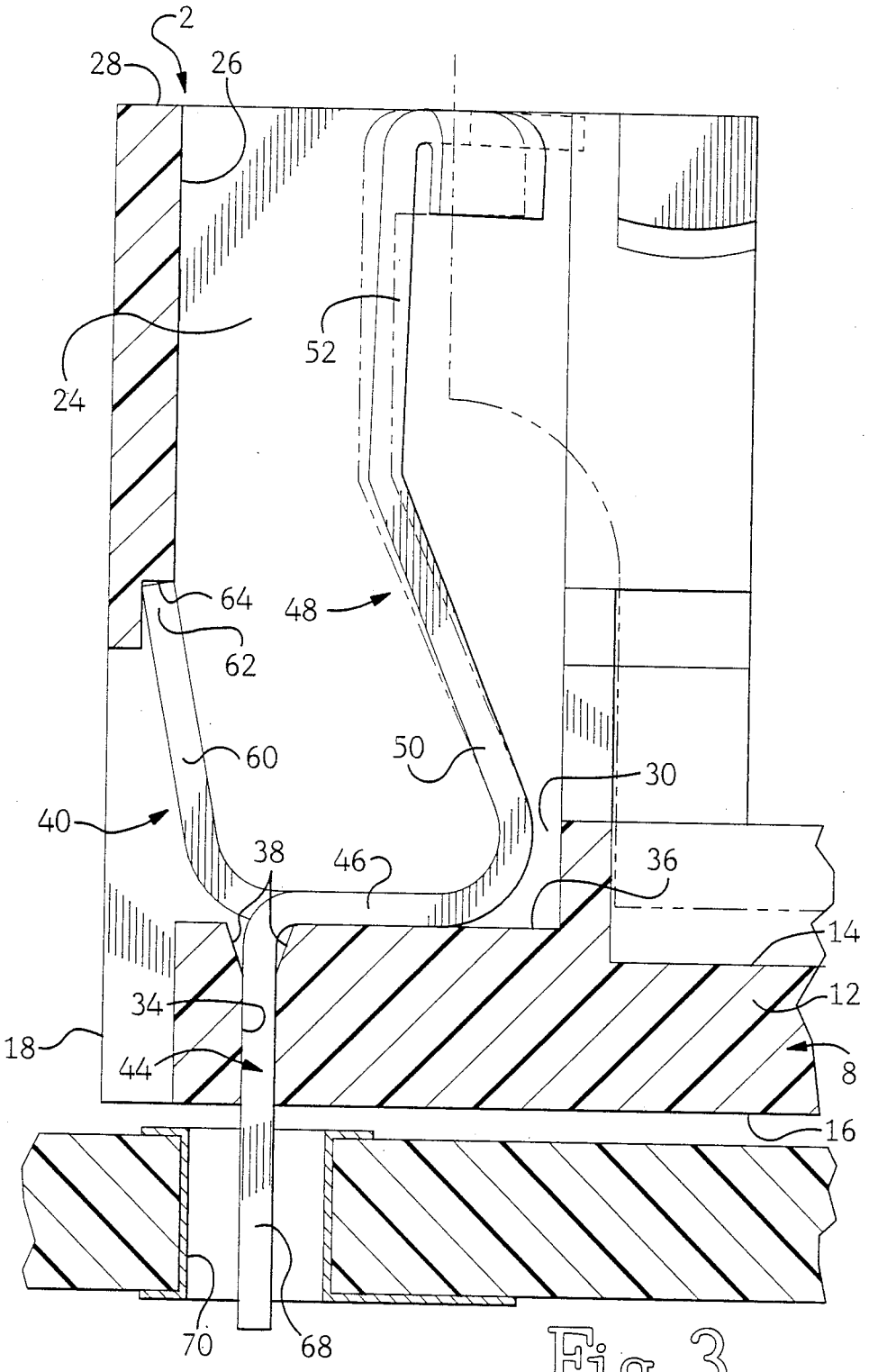
FIG. 3 is a cross-sectional view of an end portion of the connector, showing the latch member provided in a latch receiving recesses, the motion of the latch member as the daughter card is inserted into the connector is indicated by the lines shown in phantom.

Proximate ends 18 of base 8 are latch receiving recesses 24, as best shown in FIGS. 1 through 3. Each latch receiving recess 24 is provided proximate the board-receiving opening 20. As is shown in FIGS. 1 and 2, each latch receiving recess 24 has three side walls 26 which extend from an upper surface 28 of the connector housing toward the bottom surface 16 of the base. As shown in FIGS. 1 and 2, a recess 32 is provided in one of the side walls 26, the recess extending from the upper surface 28 of the housing toward the top surface 14 of the base 8. The fourth side wall 30 (FIG. 3), which is positioned adjacent the board-receiving opening 20, does not extend to the upper surface 28 of the housing.

Post receiving openings 34 extend from the bottom surface 16 of base 8 to the bottom walls 36 of recesses 24. As is shown in FIG. 3, post receiving openings 34 have lead-in surfaces 38 provided proximate the bottom walls 36 of the recesses 24.

Figure 7:
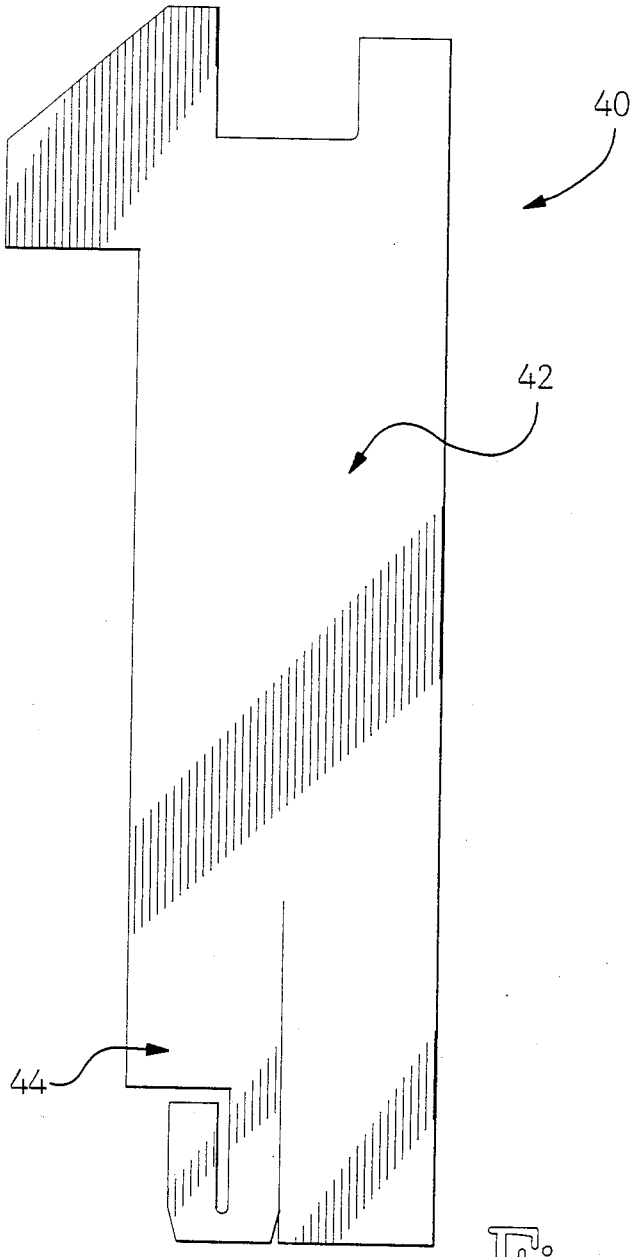
FIG. 7 is a plan view of a sheet metal blank from which the latch member is formed.

Latch members 40 are positioned in the latch receiving recesses 24. As is shown in FIG. 7, each latch member is stamped from sheet metal stock having the desired resilient and electrical characteristics. The latch members are then formed into the configuration shown in FIGS. 4 through 6.

Figures 4, 5, 6:
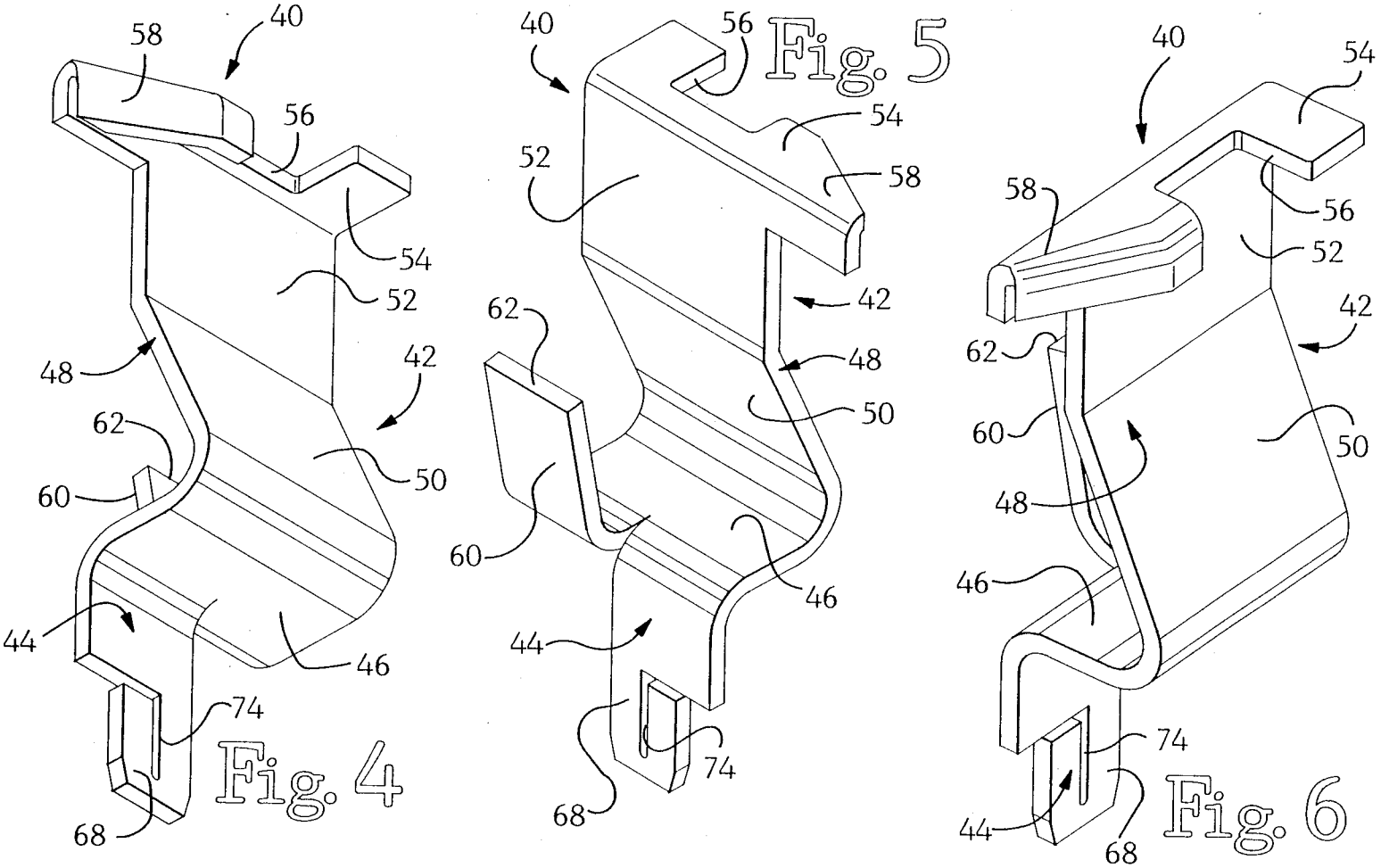
FIG. 4 is a perspective view of the latch member removed from the latch receiving recess of the connector.
FIGS. 5 and 6 are perspective views of the latch member removed from the latch receiving recess, these views differ from FIG. 4 only in the angle at which the latch member is viewed.

For ease of explanation and understanding, only one latch member 40 will be described in detail. However, it is important to note that in most applications, more than one latch member will be used in a connector. As shown in FIG. 5, each latch member 40 has a resilient section 42 and a mounting section 44. The resilient section 40 has a base portion 46 which has two ends provided thereon. Extending from a first end of the base portion 46 is resilient arm 48. The resilient arm has an angled portion 50 which extends at an angle from the free end of the base portion 46. An intermediate portion 52 extends from an end of the angled portion 50 in a direction which is essentially perpendicular to the base portion 46.

A latch projection 54 is provided at the upper surface of the intermediate portion 52. The latch projection 54 extends from the intermediate portion 52, in a direction which is essentially perpendicular to the intermediation portion. A board edge receiving opening 56 is provided in the latch projection 54 to allow the daughter board to be inserted therein, as will be more fully described.

An engagement projection 58 extends from a side edge of the intermediation portion 52 and from an edge surface of the latch projection 54. As shown in FIGS. 1 and 2, the engagement projection 58 extends beyond the housing of the connector, thereby allowing a technician to engage the engagement projection 58.

The general configuration of the resilient arm 48 of the latch member 40 provides the resilient characteristics required to insure for the proper and continued use of the latch member over many cycles. However, other configurations of the resilient arms are possible. In fact, it is conceivable that due to space considerations, each latch member provided in the connector may have a slightly different appearance. The operation of the each latch member, no matter the configuration, is essentially identical to the operation of the latch member described herein.

A securing arm 60 is provided at a second end of base portion 46. As best shown in FIG. 3, securing arm 60 extends from the base portion 46 towards the upper surface 28 of the connector housing, in essentially the same direction as the angled portion 50 of resilient arm 48. A free end 62 of securing arm 60 cooperates with a shoulder 64 provided on one of the side walls 26 of the latch receiving recess 24. It should be noted that the configuration of the securing arm and the shoulder of the side wall allows the latch member 40 to be inserted into the latch member receiving recess 24 through the upper surface 28 of the connector housing. As insertion occurs, securing arm 60 will be caused to move to the right as viewed in FIG. 3, thereby placing the securing arm in a stressed position. Once the latch member 40 is fully inserted into the recess 24, the free end 62 of the securing arm 60 will be resiliently displaced into the shoulder 64 of the side wall, thereby preventing the removal of the latch member 40 from the latch receiving recess 24. The configuration of the securing arm 60 and the base portion 40 enhance the resilient characteristics of resilient arm 48.

Referring back to FIG. 5, mounting section 44 extends from the second end of base portion 46, in a direction toward the bottom surface 16 of the base of the connector. It should be noted that the width of the securing arm 60 plus the width of the mounting section 44 is equal to the width of the base portion 46, as best shown in FIG. 7.

Mounting section 44 extends beyond the bottom surface 16 of the base 12 to cooperate with a printed circuit board (mother board) 4. A board engagement portion 68 is provided on the mounting section 44 to insure that the latch member will be provided in engagement with an opening 70 provided in the printed circuit board 4. The width of portion 68 is slightly larger than the width of a corresponding opening 70 in the printed circuit board. Consequently, as the portion 68 is inserted into the opening 70, the portion 68 is allowed to deform due to the presence of slot 74. This deformation allows the board engagement portion 68 to be inserted into the opening 70. This type of deformation causes portion 68 to exert a force on the walls of the opening when the portion 68 is properly inserted therein, thereby insuring that the portion 68 will be maintained in the opening 70.

With the connector secured to printed circuit board 4, a daughter card 6 is positioned in the board-receiving opening 20 at an angle. The daughter card 6 must then be rotated to the position shown in FIGS. 1 and 2. As this rotation occurs, the daughter card 6 engages the engagement projection 58. This causes the resilient arm 48 to be moved toward the end 18 of the connector, as indicated by the lines drawn in phantom in FIG. 3. The resilient deformation of the resilient arm allows the daughter card 6 to continue its turning motion. When the card is essentially perpendicular to printed circuit board 4, the daughter card 6 enters the board edge receiving opening 56, thereby disengaging the projections, allowing the resilient arm to snap back in place. The daughter card is now secured in position between the latching projection 54 and stop member 78 provided on the housing.

To remove the daughter card 6 from the connector, the technician engages the engagement projection 58 and moves the projection toward end 18. This causes the resilient arm 48 to be moved to the position indicated by the lines drawn in phantom in FIG. 3, thereby allowing the daughter card 6 to be rotated in the opposite direction of that previously described.

Several advantages are provided by the type of latch member 40 described herein. Due to the fact that the latch member 40 is insertable into the housing, and therefore is not molded from the same plastic material as the housing, the latch member 40 is usable over many more cycles. The material from which the latch member 40 is manufactured can be chosen to maximize the resilient and strength characteristics of the resilient arm 48. Consequently, as daughter boards are inserted and removed, each resilient arm 48 will not take a permanent set, and will therefore be usable over a great number of cycles.

Also, because of the enhanced characteristics of the latch member 40, the resilient arm 48 is capable of accommodating a wider range of card widths. This is an important advantage, as the tolerance limits associated with the daughter cards 6 can be significant. In the prior art, when a relatively wide card was inserted into the connector, it would cause the plastic latches to take a permanent set. Consequently, when a relatively small card was inserted, the latches could not retain the card in position. With the present invention this result is eliminated, as the latch members 40 will not take a permanent set due to the varied dimensions of the cards.

In the prior art, if the latch is damaged, the entire connector must be replaced. This can be a costly proposition, as all the contacts, etc. in the connectors are discarded. However, in the present invention, if the latch members are damaged, only the latch member 40 need be replaced. Consequently, the remaining portion of the connector is salvaged.

Another advantage of this latch member 40 relates to the strength characteristics of the mounting section 44. In prior art connectors, in which the mounting posts are molded from the same material as the housing, the posts are inherently weak. Consequently, the failure of the post during shipping or insertion resulted in a major problem, as the failure of the post caused the entire connector being ineffective. However, in the present invention, the mounting section 44 is made from a material having significant strength characteristics. Therefore, damage to the mounting section during shipping and insertion is essentially eliminated, resulting in a much more reliable connector.

One of the most significant advantages of the latch member 40 described herein is directed to the electrical characteristics which are provided. In this age of miniaturization, when board real estate is at a premium, it is essential that connectors occupy minimal space. It is therefore important that the contact terminals provided in the connector be as few as possible In an attempt to achieve this result, it is extremely beneficial to provide contact terminals which only transmit communication signals thereacross. In other words, the power and ground transmissions are provided by other means. In the present invention, due to the electrical characteristics of the latch members 40, the power and ground can be supplied from the printed circuit board 4 to the daughter card 6 through the latch members. The power is supplied from board 4 by way of opening 70. Board engagement section 68 is provided in electrical engagement with the opening, such that the power signals are transmitted from board 4 to latch member 40, which is comprised of electrically conductive material. The power signals are supplied to the daughter card 6 by means of the electrical connection provided between the latch projections 54 and conductive areas 80 of the daughter card 6, as shown in FIGS. 1 and 2. It should be noted that in order to provide for the electrical engagement required between the daughter card and the latch member, the board edge receiving recess with which the daughter card cooperates must be precisely dimensioned.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical connector for connecting a first substrate to a second substrate, the second substrate being rotatable relative to the first substrate between a first and second position, the electrical connector having a housing with a recess provided therein, the recess extends from proximate a first end of the housing to proximate a second end of the housing, and is dimensioned to receive the second substrate therein, contact terminals are positioned adjacent to the recess, and are configured to make an electrical connection with the second substrate when the second substrate is in the second positioned in the recess, the electrical connector comprising:

a latch receiving cavity provided in the housing and extending from a first surface of the housing toward a second surface, the latch receiving recess positioned proximate to the first end of the housing and proximate the recess of the housing;

a separate resilient latching means positioned in the latch receiving cavity, the latching means having a mounting portion which is positioned in the latch receiving cavity, and a latching portion which extends from the latch receiving cavity toward the recess;

whereby as the second substrate is rotated from the first position to the second position, the latching portion of the latching means cooperates with the second substrate to maintain the second substrate in the second position.

2. An electrical connector as recited in claim 1 wherein the latching means is a metal member which has the appropriate resilient characteristics to allow the latching means to be used over many cycles.

3. An electrical connector as recited in claim 2 wherein the mounting portion of the latching means has two opposed resilient arms which extend from a base portion, an inner arm being adjacent to the recess and an outer arm engaging the first end wall of the housing to secure the latching means in the latch receiving cavity, the inner arm being deflectable toward the outer arm, such that as the second substrate is rotated between the first position and the second position, the inner arm is deflected toward the outer arm.

4. An electrical connector as recited in claim 2 wherein the latching portion of the latching means is positioned outside of the latch receiving cavity, and extends toward the recess of the housing, such that as the second substrate is rotated from the first position to the second position, the latching portion of the latching means will cooperate with an end of the second substrate, to maintain the latching portion is cooperation with second electrical component when the second electrical component is provided in the second position.

5. An electrical connector as recited in claim 2 wherein the latching portion has an engagement portion and a substrate receiving cavity provided adjacent to the engagement portion, the engagement portion has a lead-in surface provided thereon, such that as the second substrate is rotated from the first position to the second position, the second substrate will engage the lead-in surface of the engagement portion, causing the an arm of the resilient latching means to be cammed toward the first end of the housing, thereby allowing the for the continued rotation of the second substrate to the second position.

6. An electrical connector as recited in claim 5 wherein the substrate receiving cavity has a retention shoulder provided proximate thereto, such that as the second substrate is rotated to the second position, the retention shoulder will cooperate with the second substrate to maintain the substrate in the substrate receiving cavity.

7. An electrical connector as recited in claim 2 wherein the latching means has a first substrate cooperation portion, the cooperation portion extends through the housing to make electrical connection with the first substrate, such than an electrical pathway is established through the latching means between the first substrate and the second substrate when the second substrate is provided in the second position.

8. An electrical connector for connecting a first printed circuit board to a second printed circuit board, the electrical connector comprising:

a housing of dielectric material, mountable on the first printed circuit board, the housing including a base having an opening for receiving the second printed circuit board;

a separate resilient latch on at least one end of the opening; and a latch receiving recess adjacent at least on end of the opening in which the latch is positioned, the latch receiving recess having an open upper end, the latch being insertable into the recess through the upper end, the latch having two arms extending upwardly from a base portion, an inner arm being adjacent the opening and an outer arm engaging an end wall of the housing to secure the latch in the recess, the inner arm being deflectable toward the outer arm, the inner arm having a latch projection extending inwardly from the inner arm, the latch projection extending in a direction such that engagement between the latch projection and the second printed circuit board, during rotation of the second printed circuit board into the housing, causes the inner arm to be deflected toward the outer arm.

9. An electrical connector as recited in claim 8 wherein the separate resilient latch is a metal member which has the appropriate resilient characteristics to allow the inner arm to deflect as required.

10. An electrical connector as recited in claim 9 wherein the outer arm is positioned entirely in the latch receiving recess, and the inner arm extends from the recess in a direction away from the base and away from the end wall of the housing, the inner arm has a latching section and a releasing section provided thereon.

11. An electrical connector as recited in claim 10 wherein the latching section has a printed circuit board receiving cavity and a retention shoulder, and the releasing section has a lead-in surface, whereby the second printed circuit board is released from the second position by a force applied to the releasing section, thereby causing the inner arm to deflect toward the outer arm, allowing the second printed circuit board to be rotated back toward the first position.

12. An electrical connector as recited in claim 8 wherein a portion of the outer arm cooperates with a recess provided in the end wall of the housing to maintain the latch in the latch receiving recess.

13. An electrical connector for connecting a first printed circuit board to a second printed circuit board, the electrical connector comprising:

a housing of dielectric material, mountable on the first printed circuit board, the housing including a base having an opening for receiving the second printed circuit board;

a plurality of contacts positioned in the base adjacent the opening for establishing an electrical interconnection to the second printed circuit board;

a separable metal latch on at least one end of the opening, the latch having a flexible inner arm and an outer securing arm; and a latch receiving recess adjacent at least one end of the opening in which the latch is positioned, the metal latch being secured in the housing by engagement of the securing arms with the housing, the resilient arm having a latch projection, the latch projection extending in a direction such that engagement between the latch projection and the second printed circuit board, during rotation of the second printed circuit board into the housing, causes the resilient arm to be deflected toward the securing arm.

14. An electrical connector as recited in claim 13 wherein the inner arm and the outer securing arm extend from a base portion, the inner arm being adjacent to the opening and the outer securing arm being positioned proximate to an end wall of the housing, the inner arm being deflectable toward the outer securing arm.

15. An electrical connector as recited in claim 14 wherein the outer securing arm is positioned entirely in the latch receiving recess, and the inner arm extends from the recess in a direction away from the base and away from the end wall of the housing.

16. An edge connector for interconnecting first and second circuit boards, the edge connector comprising:

an insulating housing having a plurality of contacts along the length of the insulating housing and openings at both ends of the insulating housing; and a pair of board latching devices to be inserted and secured in the openings in the insulating housing, each of the board latching devices is made of a metal plate member having a latching section to latch the second circuit board and a releasing section to release the latching of the second circuit board.

17. An edge connector as recited in claim 16 wherein the latching devices have mounting portions which are positioned in the openings of the housing, and latching portions which extend from the openings toward the contacts positioned in the housing, whereby as the second circuit board is rotated from a first position to a second position, the latching portions of the latching devices cooperate with the second circuit board to maintain the second circuit board in the second position.

18. An edge connector as recited in claim 17 wherein the mounting portions of the latching devices have opposed resilient arms which extend from base portions, inner arms of the mounting portions are provided adjacent to the contacts and outer arms engage outer walls of the housing to secure the latching devices in the openings, the inner arms being deflectable toward the outer arms.

19. A circuit board latching device for a connector comprising:

a mounting section to be mounted in an opening in an insulating housing for a connector;

a circuit board latching section to latch a circuit board; and a releasing section for externally releasing the latching of the circuit board by the circuit board latching section;

wherein the mounting, latching and releasing sections are integrally made of a metal plate member.

* * * * *

UNITED STATES PATENT AND TRADEMARK OFFICE
CERTIFICATE OF CORRECTION

PATENT NO. : 4,986,765

DATED : January 22, 1991

INVENTOR(S) : Iosif Korsunsky et al.

It is certified that error appears in the above-identified patent and that said Letters Patent is hereby corrected as shown below:

IN THE CLAIMS:

In claim 1, column 6, line 64, before "second position", insert --a--; at column 7, lines 3-4, delete "positioned" and substitute --position--; at line 8, delete "recess" and substitute --cavity--.

In claim 4, column 7, line 43, delete "is" and substitute --in--; at line 44, before "second", (1st occurr) insert --the--; at line 44, delete "electrical component" and substitute --substrate--; and at line 45, delete "electrical component" and substitute --substrate--.

In claim 5, column 7, line 53, after "causing", delete "the"; and at line 56, before "for the continued", delete "the".

In claim 8, column 8, line 14, after "adjacent at least", delete "on" and substitute --one--.

In claim 11, column 8, line 45, before "second", delete "the" and substitute --a--; and at line 49, after "toward", delete "the" and substitute --a--.

UNITED STATES PATENT AND TRADEMARK OFFICE

CERTIFICATE OF CORRECTION

PATENT NO. : 4,986,765

DATED : January 22, 1991

INVENTOR(S) : Iosif Korsunsky et al.

It is certified that error appears in the above-identified patent and that said Letters Patent is hereby corrected as shown below:

In claim 13, column 8, line 65, after "having a", delete "flexible" and substitute --resilient--; at column 9, line 2, delete "arms" and substitute --arm--.

Signed and Sealed this

Twenty-second Day of December, 1992

*Attest:*

DOUGLAS B. COMER

*Attesting Officer*

*Acting Commissioner of Patents and Trademarks*